US006408286B1

(12) United States Patent
Heiden

(10) Patent No.: US 6,408,286 B1
(45) Date of Patent: Jun. 18, 2002

(54) POSTAGE PRINTING SYSTEM HAVING A DIGITAL COUPON DISTRIBUTION SYSTEM

(75) Inventor: Richard W. Heiden, Huntington, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/224,238

(22) Filed: Dec. 30, 1998

(51) Int. Cl.[7] ..... G07B 17/00
(52) U.S. Cl. ..... 705/408; 101/71; 283/71
(58) Field of Search ..... 101/71; 283/71; 705/401, 408, 410

(56) References Cited

U.S. PATENT DOCUMENTS

| | | | | |
|---|---|---|---|---|
| 4,639,873 A | | 1/1987 | Baggarly et al. | 364/466 |
| 4,725,718 A | | 2/1988 | Sansone et al. | 235/495 |
| 4,734,865 A | | 3/1988 | Scullion et al. | 364/478 |
| 4,797,830 A | | 1/1989 | Baggarly et al. | 364/464.03 |
| 4,831,554 A | | 5/1989 | Storace et al. | 364/519 |
| 4,873,645 A | | 10/1989 | Hunter et al. | 364/479 |
| 4,959,795 A | | 9/1990 | Christensen et al. | 364/464.03 |
| 5,008,827 A | | 4/1991 | Sansone et al. | 364/464.02 |
| 5,024,153 A | | 6/1991 | Bannister et al. | 101/91 |
| 5,039,075 A | * | 8/1991 | Mayer | 270/1.02 |
| 5,043,908 A | | 8/1991 | Manduley et al. | 364/478 |
| 5,058,030 A | | 10/1991 | Schumacher | 364/478 |
| 5,072,400 A | | 12/1991 | Manduley et al. | 364/478 |
| 5,087,805 A | | 2/1992 | Silverschotz et al. | 219/121.71 |
| 5,168,804 A | | 12/1992 | Lee et al. | 101/99 |
| 5,177,687 A | | 1/1993 | Baggarly et al. | 364/464.03 |
| 5,454,038 A | | 9/1995 | Cordery et al. | 380/23 |
| 5,490,077 A | | 2/1996 | Freytag | 364/464.02 |
| 5,509,109 A | | 4/1996 | Kim et al. | 395/114 |
| 5,579,449 A | | 11/1996 | Strobel | 395/110 |
| 5,748,484 A | * | 5/1998 | Cannon et al. | 700/233 |
| 5,761,648 A | | 6/1998 | Golden et al. | 705/14 |
| 5,819,241 A | | 10/1998 | Reiter | 705/408 |
| 5,822,739 A | | 10/1998 | Kara | 705/410 |
| 6,141,654 A | * | 10/2000 | Heiden et al. | 705/408 |
| 6,154,733 A | * | 11/2000 | Pierce et al. | 705/408 |
| 6,173,274 B1 | * | 1/2001 | Ryan, Jr. | 705/408 |
| 6,178,411 B1 | * | 1/2001 | Reiter | 705/408 |
| 6,202,005 B1 | * | 3/2001 | Mahaffey | 700/221 |
| 2001/0023408 A1 | | 9/2001 | McEvoy et al. | 705/14 |

FOREIGN PATENT DOCUMENTS

WO WO-97/14117 A2 * 4/1997

OTHER PUBLICATIONS

Dougherty: "Advertising: Postage Stamp As Ad Medium Medium"; New York Times Feb. 14, 1986, col. 1, p. 15, section 4 (Abstract Only).*

Scisco: "Making labels with a computer"; Office Systems, Mar. 1999, vol. 16, No. 3, pp. 34–37.*

* cited by examiner

*Primary Examiner*—Edward R. Cosimano
(74) *Attorney, Agent, or Firm*—Angelo N. Chaclas; Charles R. Malandra, Jr.

(57) ABSTRACT

A postage printing system, comprising a computer, a data center, a control system and a redemption center. The computer is in operative communication with a printer for printing a postal indicium on an envelope. The data center is in operative communication with the computer, which in turn is located remotely from the data center. The data center includes a plurality of user accounts and a plurality of advertiser accounts where each of the plurality of advertiser accounts includes respective ad data including coupon data and restriction data. The control system is in operative communication with the data center and the computer and is for: (i) establishing a transaction session between a user of the computer corresponding to one of the plurality of user accounts and the data center; (ii) obtaining recipient address information from the user; and (iii) using the recipient address information and the restriction data from the plurality of advertiser accounts to identify coupon data available for printing on the envelope in conjunction with the postal indicium. The redemption center is in operative communication with the data center and coupon redeemers for reconciling payments corresponding to redeemed coupons.

29 Claims, 5 Drawing Sheets

POSTAGE PRINTING SYSTEM HAVING A DIGITAL COUPON DISTRIBUTION SYSTEM

CROSS REFERENCE TO RELATED APPLICATIONS

This application is related to the following patent or co-pending applications filed concurrently herewith and commonly assigned to the assignee of this application: U.S. Pat. No. 6,154,733, entitled POSTAGE PRINTING SYSTEM HAVING VARIABLE SUBSIDIES FOR PRINTING OF THIRD PARTY MESSAGES; U.S. Pat. No. 6,173,274, entitled PRODUCTION MAIL SYSTEM HAVING SUBSIDIES FOR PRINTING OF THIRD PARTY MESSAGES ON MAILPIECES; and U.S. Pat. No. 6,141,654, entitled POSTAGE PRINTING SYSTEM HAVING SUBSIDIZED PRINTING OF THIRD PARTY MESSAGES; and U.S. patent application Ser. No. 09/222,642, entitled SYSTEM AND METHOD FOR SUBSIDIZED PRINTING OF THIRD PARTY COUPONS FOR INSERTION INTO A SPECIFIC MAILPIECE, all of which are specifically incorporated herein by reference.

FIELD OF THE INVENTION

The present invention relates generally to postage printing systems. More particularly, the present invention is directed to a postage printing system including subsidies for printing of third party coupons.

BACKGROUND OF THE INVENTION

Postage printing systems are well known in the art. A typical postage meter (one example of a postage printing system) applies evidence of postage, commonly referred to as a postal indicium, to an envelope or other mailpiece and accounts for the value of the postage dispensed. As is well known, postage meters include an ascending register, that stores a running total of all postage dispensed by the meter, and a descending register, that holds the remaining amount of postage credited to the meter and that is reduced by the amount of postage dispensed during a transaction. The postage meter generally also includes a control sum register that provides a check upon the descending and ascending registers. The control sum register has a running account of the total funds being added into the meter. The control sum register must always correspond with the summed readings of the ascending and descending registers. The control sum register is the total amount of postage ever put into the machine and it is alterable only when adding funds to the meter. In this manner, by inspecting the various registers and securing them from tampering, the dispensing of postal funds may be accurately recorded, tracked and accounted for.

More recently, a postage printing system has been developed where the accounting structure described above is no longer resident with the user. Sometimes referred to as a "virtual postage meter", these types of postage printing systems dispense postage electronically over suitable communication channels (LAN, WAN, telephone lines, Internet, etc.). The user maintains an account with a remotely located data center (maintained by an authorized postage meter manufacturer) and receives postage securely using appropriate electronic data interchange techniques. At a later time, the user is invoiced for the amount of postage dispensed and any other fees associated with maintaining the account with the data center. Oftentimes, a secret code or token is derived from information particular to the mailpiece (the indicated postage amount, date, recipient address information, etc.) and is incorporated or embedded into the postal indicium for later use by a postal authority in verifying the integrity of the postal indicium. Examples of such systems are described in U.S. Pat. Nos. 4,725,718 and 5,454,038.

It is also known to print selected coupons (sometimes referred to as ad slogans although such coupons are not restricted to advertisements) along with the postal indicium. Generally, the coupon bears no relation to the postal indicium. In traditional postage meters employing either rotary drum or flat bed printing technology, the coupon was printed along with the postal indicium by including an additional printing die representative of the coupon. These dies were typically costly to manufacture and distribute and cumbersome for the postage meter user to install. Examples of die based systems for printing coupons are disclosed in U.S. Pat. Nos. 5,168,804 and 5,024,153. More recently, the postage meter industry has begun to incorporate digital (dot matrix) printing technology which obviates the need for dies as the digital printer may be supplied with suitable drive signals to effect printing of the coupon. Examples of digital printing technology based systems for printing coupons are disclosed in U.S. Pat. Nos. 4,831,554 and 5,509,109.

Additionally, U.S. Pat. No. 4,831,554 teaches a system that allows the postage meter manufacturer to broker the use of advertising space by third parties on the envelopes. In concept, a third party advertiser may wish to take advantage of the space on the outgoing envelopes from a particular postage meter user to advertise its own products and/or services. In this system, a coupon the content of which originates from a third party is stored electronically within the postage meter. The postage meter keeps a count of the number of times that the coupon is printed in conjunction with the postal indicium. This count is then used by the data center to provide a subsidy to the postage meter user during a subsequent billing cycle and is correspondingly used by the data center to invoice the third party advertiser.

Although this brokering system represents a new business opportunity for postage meter manufacturers, it suffers from certain drawbacks and disadvantages. First, the third party advertiser cannot exercise any control over when the coupon is dispensed. Thus, if the coupon is time sensitive, then the relevance of the coupon may be lost after a certain date and the third party advertiser would be compelled to pay for advertising that was not effective. For example, advertisements directed to promotions that have expiration dates (rebate programs, concert tickets, limited time offers, etc.) are useless once the relevant time has passed. Second, the third party advertiser cannot exercise any control over the number of coupons dispensed. Thus, if the third party advertiser allocated a fixed advertising budget and accordingly only wanted to pay for a limited number envelopes containing the coupon, then the third party advertiser may be compelled to pay for advertising that was not wanted if the postage meter user generates increased mail volume over that which was anticipated. Third, the third party advertiser cannot exercise any control over the recipient of the coupon. Thus, the third party advertiser has no assurance that a target audience would be reached. For example, advertisements (e.g. sports related or hair loss, as examples) intended primarily for males may not be relevant if the recipient of the envelope from the postage meter user was a female. Fourth, the third party advertiser cannot exercise any control over the geographic reach of the coupon. Here again, the third party advertiser has no assurance that the target audience would be reached. For example, advertisements (e.g. local car dealership or cleaning service, as examples) intended for a certain limited geographic region would not be relevant if the recipient of the envelope from the postage meter user was located many miles away from the certain limited geographic region. As a related example, advertisements intended for the certain limited geographic region on envelopes originating from outside of the certain limited geographic region would not benefit from the increased good will of being associated with a sender in the certain limited geographic region.

As described above, the effectiveness of the third party coupons printed on envelopes is low. Because of the above drawbacks and disadvantages, the fees that third party advertisers would be willing to pay the postage meter manufacturer are relatively low. In turn, the subsidies that the postage meter manufacturer is able to pass along to the postage meter user are correspondingly relatively low. Thus, in the absence of a meaningful economic incentive there is little motivation for third party advertisers and postage meter users to participate in the above described system for placing third party advertising on envelopes.

Therefore, there is a need for an improved system that allows the postage meter manufacturer to broker the use of advertising space by third parties on envelopes. More particularly, there is a need for a system that places the coupons on envelopes in a more effective manner so third party advertisers are more likely to reach their target audiences. In this manner, the third party advertisers would be willing to pay higher fees resulting in an increased economic incentive for third party advertisers and postage meter users to participate.

SUMMARY OF THE INVENTION

The present invention provides system and method for improving the effectiveness of third party advertising on envelopes by printing redeemable coupons on envelopes. Generally, this is accomplished by letting the third party advertisers establish conditions under which their coupons would be printed on the envelopes coupon. The conditions may be based upon user (sender) parameters, recipient parameters, quantitative parameters (time, piece count, etc.) or some combination of the above. Furthermore, the printed coupons may include secure information, preferably in the form of a bar code, by which the coupon may be authenticated upon redemption. The coupon preferably includes demographic information that can be collected by a retailer, the third party advertiser, or the vendor administering the coupon distribution system.

In accordance with the present invention, there is provided a postage printing system comprising a computer, a data center, a control system and a redemption center. The computer is in operative communication with a printer for printing a postal indicium on an envelope. The data center is in operative communication with the computer, which in turn is located remotely from the data center. The data center includes a plurality of user accounts and a plurality of advertiser accounts where each of the plurality of advertiser accounts includes respective ad data including coupon data and restriction data limiting the use of the coupon data. The control system is in operative communication with the data center and the computer and is for: (i) establishing a transaction session between user of the computer corresponding to one of the plurality of user accounts and the data center; (ii) obtaining recipient address information from the user; and (iii) using the recipient address information and the restriction data from the plurality of advertiser accounts to identify coupon electronic coupon data available for printing on the envelope in conjunction with the postal indicium. The redemption center is in operative communication with the data center and coupon redeemers for reconciling payments corresponding to redeemed coupons.

In accordance with the present invention, a method of operating a postage printing system, a method of operating a data center and a method for redeeming the electronic coupons are also provided.

Therefore, it is now apparent that the present invention substantially overcomes the disadvantages associated with the prior art. Additional advantages of the invention will be set forth in the description, which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
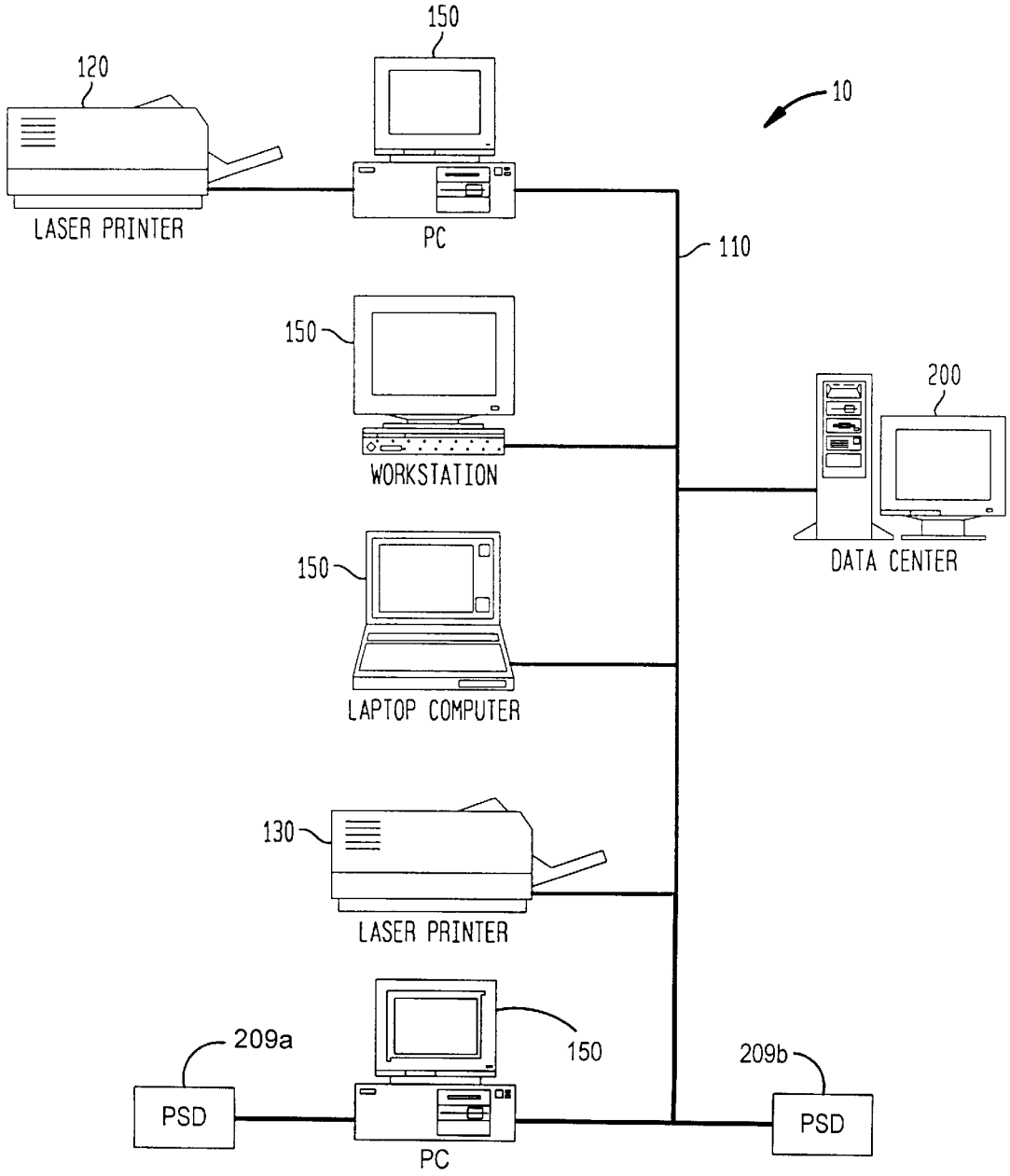
FIG. 1 is a simplified representation of a postage printing system including a data center and a plurality of remotely located computer systems in electronic communication with the data center in which the present invention may be incorporated.

Referring to FIG. 1, and example of a postage printing system 10 indicative of one example of a virtual postage metering environment in which the present invention may be incorporated is shown. Generally, the postage printing system 10 includes a data center 200 in communication over any suitable communication network 110 (LAN, WAN, telephone line, internet, etc.) with a plurality of remotely located computers (personal computer, workstation, laptop computer or the like) 150. Generally, it is anticipated that the computers 150 would be located in small business offices and/or in private residences and used for a variety of purposes including obtaining postage. The data center 200 is maintained and operated by an authorized postage meter manufacturer or some other authorized agency. The computers 150 may be connected directly to a printer 120 or have access to a printer 130 over the suitable communication network 110. Those skilled in the art will recognize that data center 200 may be accessed through a plurality of networks and network types, i.e., each computer 150 does not need to use the same network 110 in contacting the data center 200. Likewise, the computer 150 may use one type of network 110 with the data center 200 and a different type of network with the printer 130. The remotely located computers 150 are representative of users wanting to obtain postage for their mailpieces (envelopes, post cards, packages and the like). It is also possible for a certain of the computers 150 to have a postal security device (PSD) 209*a* directly coupled to it. As another alternative, a PSD 209*a* may be located on the network 110 for access by multiple computers 150.

Figure 2:
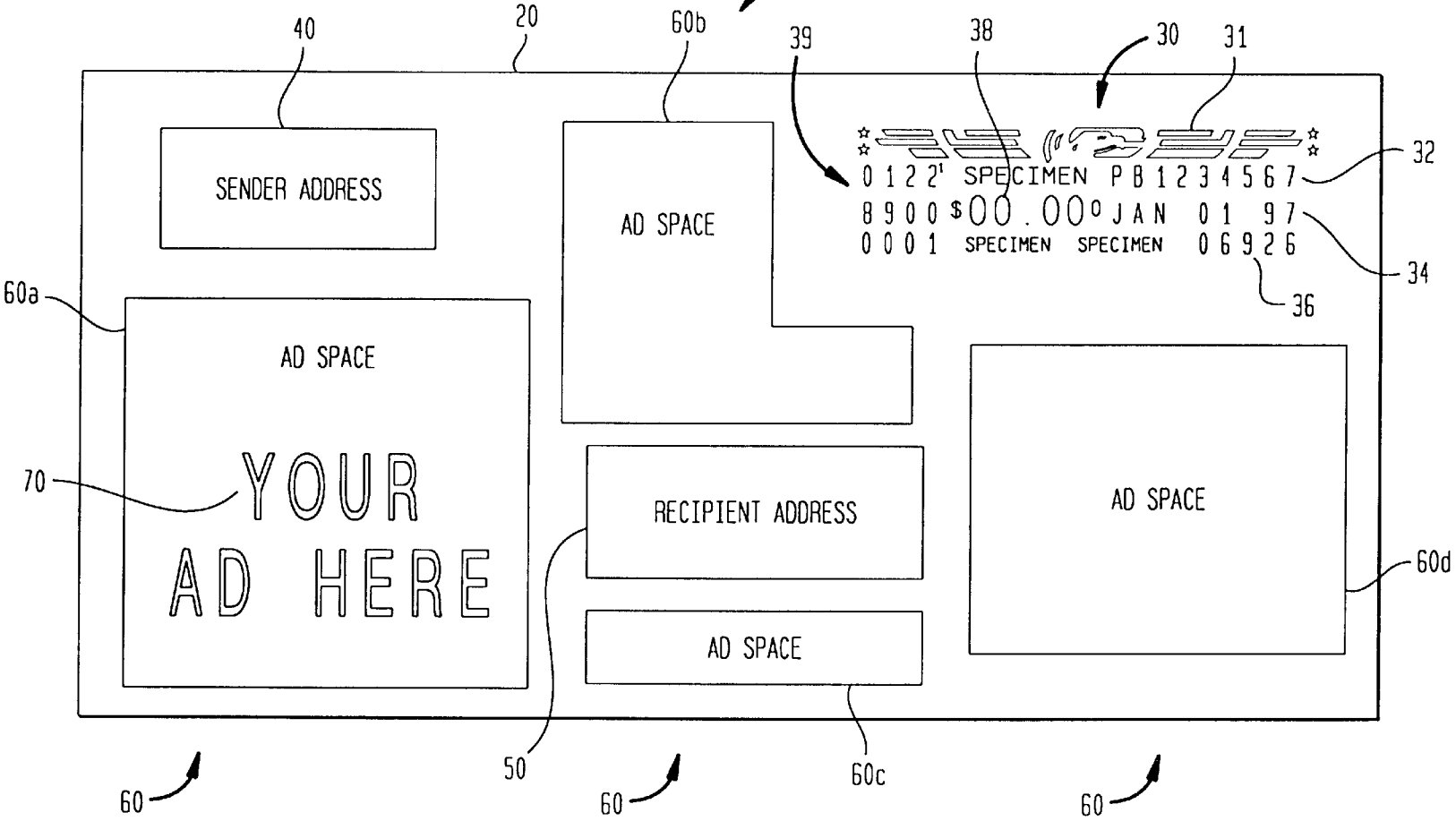
FIG. 2 is a front view of an envelope that has been processed by the postage printing system in accordance with the present invention.

Referring to FIG. 2, an envelope 20 having an example of a postal indicium 30, a sender address 40 and a recipient address 50 printed thereon is shown. The postal indicium 30 includes both fixed data that does not change from postal indicium to postal indicium and variable data that may change from postal indicium to postal indicium. Generally, the fixed data includes a graphic design 31 (an eagle with stars), a meter serial number 32 uniquely identifying the postage meter (not shown) that dispensed the postage and a licensing or receiving post office identifier (zip code) 36. Generally, the variable data includes a date 34 indicating when the postage was dispensed, a postal value 38 indicating an amount of postage and other data 39 for use by the postal authority in verifying the authenticity of the postal indicium 30 using conventional techniques. However, those skilled in the art will recognize that the exact content of both the fixed data and variable data is subject to regulation by the postal authority and a matter of design choice. For example, in a virtual meter environment, the meter serial number 32 may not be used and the receiving post office identifier (zip code) 36 may be variable data. Moreover, any format (numeric, alpha-numeric, bar code, other symbology and the like) may be employed for the verification data 39.

The further details of the envelope 20 will now be described. In conventional fashion, the postage meter user may optionally place a sender or return address 40 in the upper left hand corner of the envelope 20. As examples, the sender address 40 may be preprinted on the envelope 20, printed on an adhesive label and affixed to the envelope 20 or printed concurrently with the postal indicium 30 by the printer 120. The recipient address 50 represents the delivery point for the envelope 20. A further detailed description of the printing of the recipient address 50 and the relationship of the recipient address 50 to the postal indicium 30 will be provided below. The remainder of the envelope 20 that is not occupied by the postal indicium 30, the sender address 40 and the recipient address 50 is available as advertising space, generally designated 60, made up of a plurality of ad zones 60*a*, 60*b*, 60*c* and 60*d*. The advertising space 60 may contain one or more coupons from third party advertisers.

Figure 3:
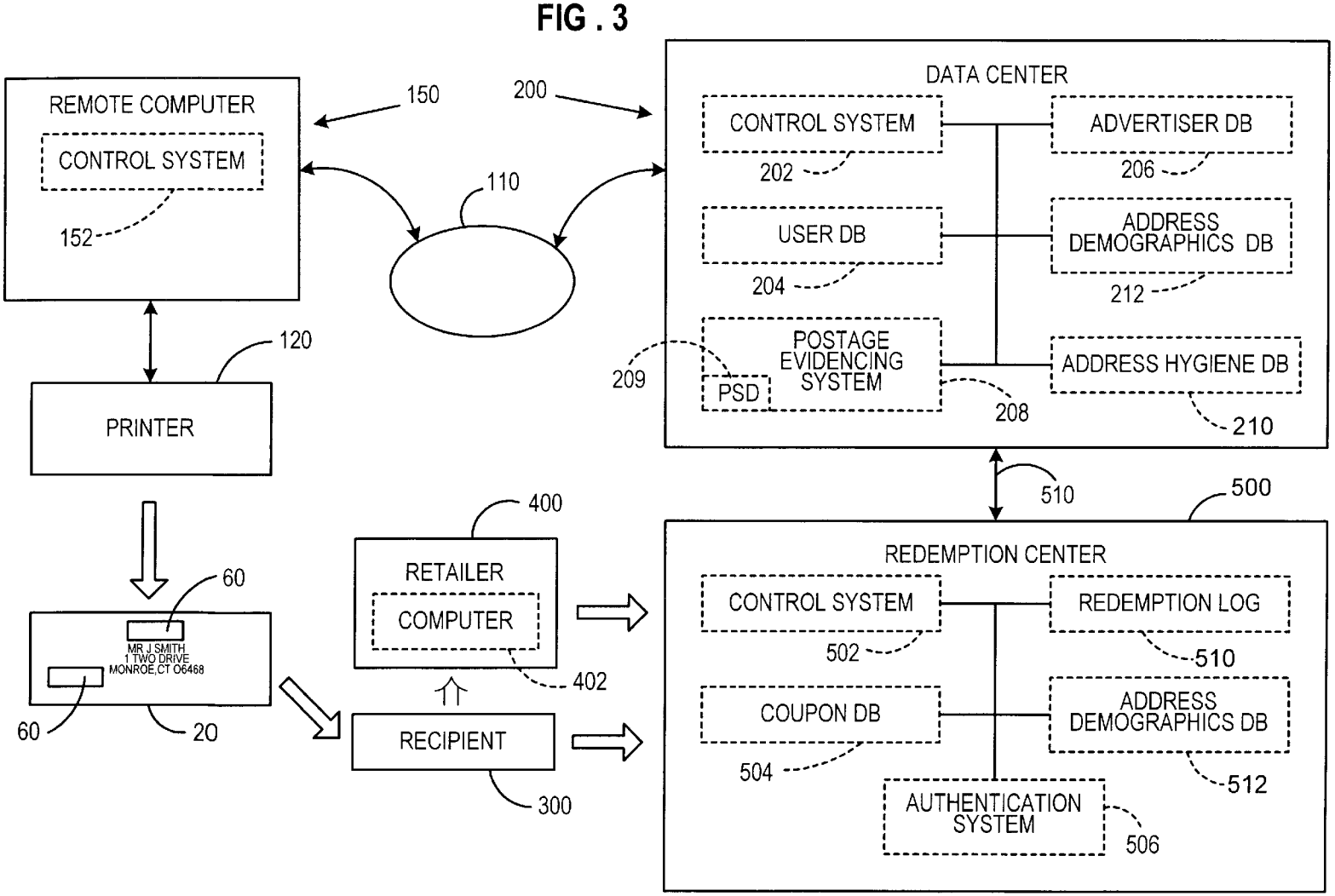
FIG. 3 is a representation of a coupon distribution system in accordance with the present invention.

Referring to FIG. 3, in view of FIG. 1, a more detailed schematic of the postage printing system 10 of the present invention is shown. The remote computer 150 includes a control system 152 that is in communication over a suitable communication network 110, such as: telephone lines, public and private network system (Internet) or the like; with a control system 202 from the data center 200. The data center 200 may be based on any conventional computer based platform (PC, server, workstation, mainframe or the like) and includes the control system 202, a user database 204, an advertiser database 206, a postage evidencing system 208, an address hygiene database 210 and an address demographics database 212, all of which are in operative communication with each other using conventional means. The user database 204 contains information concerning individual user accounts, such as: user address, preferred payment vehicle or arrangements (periodic invoice, direct credit card authorization, electronic funds transfer, etc), and the like, that been established with the postage meter manufacturer. Similarly, the advertiser database 206 contains information concerning individual advertiser accounts, such as: advertiser name, advertiser address, preferred payment vehicle or arrangements (periodic invoice, direct credit card authorizaion, electronic funds transfer, etc.), ad data and like, that have been established with the postage meter manufacturer. The address hygiene database 210 may employ any suitable database for use in cleansing submitted addresses to ensure that they are complete and correct, such as the Address Matching System (AMS) available from the United States Postal Service, Cross Check™ software system available from Pitney Bowes Inc. of Stamford, Conn. or any other commercially available system for cleansing addresses. The address demographics database 212 may employ any suitable database containing statistics relevant to certain geographic locations. As examples, various databases exists that contain detailed demographic information by zip code, such as: PRIZM available from Claritas Inc., United States census information or any other database that is generally known and commercially available.

The postage evidencing system 208 accurately records, tracks and accounts for the postal funds that are dispensed to the remote computer 150. In the preferred environment, the postage evidencing system 208 includes one or postage meters or postal security devices (PDS) 209. That is, the data center 200 may buy postage in advance from postal authority and store it in the postage meter in conventional fashion. Thus, the data center 200 may establish one postage meter per account or multiple accounts per postage meter. In either event, the postage meter manufacturer takes care of obtaining, recharging and inspecting the postage meter as required by the postal authority. On the other hand, the postage evidencing system 208 may not include a postage meter. As a trusted third party to the postal authority, the postage meter manufacturer may merely be allowed to forward a payment to the postal authority on a regular basis indicative of the amount of postage dispensed. In yet another alternative, the postal authority may operate the data center 200 itself. Thus, depending upon the exact configuration of the postage system, the PSDs 209, 209*a* and 209*b* may serve in different locations.

It is well known that different types of coupons are redeemed differently. For example, after envelope 20 received by recipient, generally designated as 300, a discount coupon would be redeemed at the time of purchase whereby the recipient redeems the coupon at a retailer, generally designated as 400, for an immediate discount. When retailed 400, receives the coupon, retailer preferably authenticates the coupon in an on-line transaction with a redemption center 500 via a retailer computer 402. Redemption center 500 includes a control system 502 that is in communication over a suitable communication network 510, such as: telephone lines, public and private network system (Internet) or the like; with a control system 202 from the data center 200. The redemption center 500 may be based on any conventional computer based platform (PC, server, workstation, mainframe or the like) and includes the control system 502, a coupon database 504, an authentication system 506, a redemption log 510 and a demographics database 512, all of which are in operative communication with each other using conventional means. Coupon database contains information of all coupons printed on mailpieces. Authentication system 504 performs the authentication of redemption request received. Redemption log 510 contains transaction records for all redeemed coupons for later use in reconciling payment to retailer 400 (or user). Demographics database 512 contains all demographic information relating to the redeemed coupons.

Alternatively, an off-line authentication may occur at retailer 400. For a rebate coupon, the recipient 300 would send the coupon directly to a redemption center 500 for rebate redemption in accordance with the terms of the coupon. The redemption process is described in more detail below.

Figure 4:
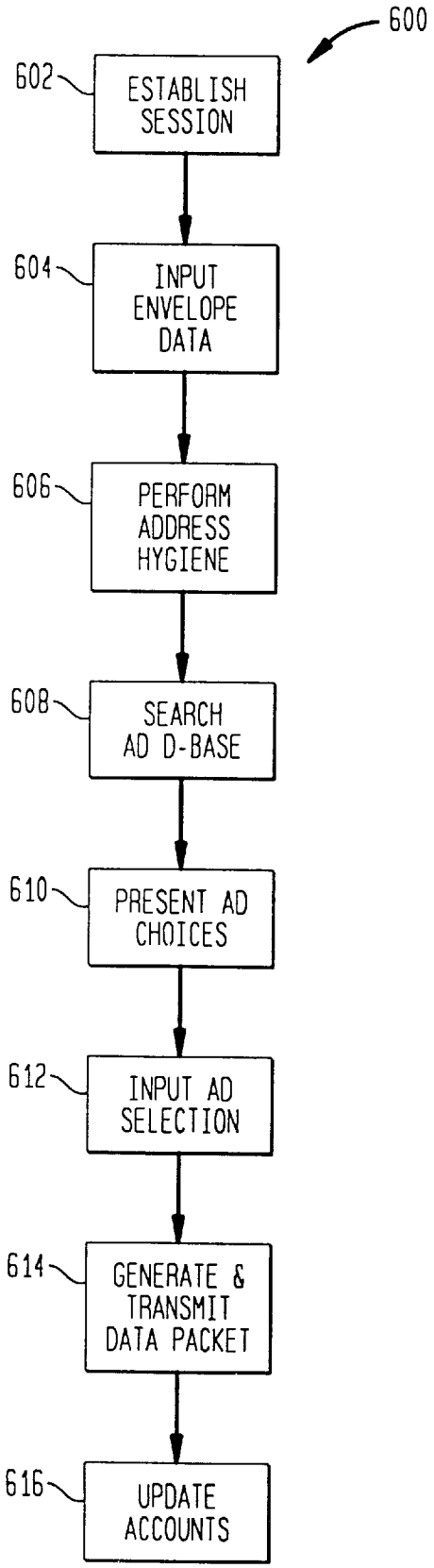
FIG. 4 is a flow chart showing the operation of the coupon distribution system in accordance with the present invention.

With the structure of the postage printing system 10 described as above, the operational characteristics will now be described with respect to a typical transaction conducted between the remote computer 150 and the data center 200. Referring primarily to FIG. 4 while referencing the structure of FIGS. 1, 2 and 3, a flow chart of a transaction routine 600 in accordance with the present invention is shown. The diagnostic routine 600 may be comprised of any suitable combination of software, firmware and hardware subsystems executed by the remote computer control system 152 and the data center control system 202. Generally, the activities of the data center 200 are such that they may be fully automated. On the other hand, the remote computer 150 includes a suitable user interface (display with keyboard having menu driven functionality) for communicating with the user. For the sake of clarity and brevity, it is assumed that the user maintains a valid account with the data center 200. It is also assumed that the user desires to include third party advertising on envelopes.

At 602, the transaction routine 600 commences when the remote computer 150 contacts the data center 200 to establish a session for the purpose of obtaining postage. In this manner, the remote computer 150 and the data center 200 recognize each other as authentic using any conventional mutual authentication technique. This generally involves the user of the remote computer 150 transmitting a valid account number or other identifying information and a corresponding password. In this manner, postage is not inadvertently supplied to one party while a second party is invoiced for the postage. Once the session has been established, at 604, the data center 200 obtains relevant data necessary to produce the postal indicium 30 for the envelope 20. This typically involves the user transmitting a desired postage amount and a recipient address 50 to the data center 200. Preferably, this is accomplished by having the user enter appropriate data fields (postage amount, 3 or 4 line address block, etc.) in a menu screen before uploading to the data center 200. Alternatively, the address information may be retrieved from a word processing document such as a letter. Next, at 606, the data center 200 performs address hygiene. Although address hygiene is not required, the results of the coupon selection will likely be improved with the cleansed addresses. The recipient address 50 received from the user is compared against the address hygiene database 210. At this time, any misspelled words are corrected and any missing information (zip code or zip +4) is filled in from the address hygiene database 210 to yield a hygiened or corrected recipient address 50. If the data center 200 cannot verify the integrity of the recipient address 50 received from the user, then the user may be instructed to check the recipient address 50 and resubmit it.

Figure 5:
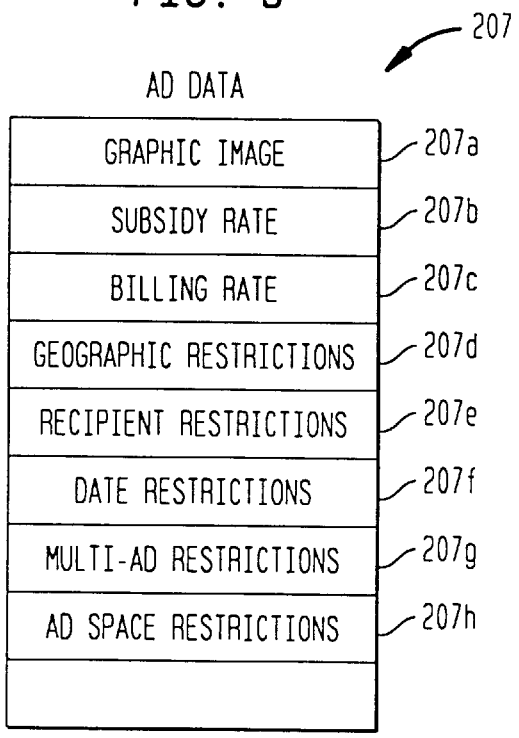
FIG. 5 is a schematic representation of an ad data file associated with a third party coupon to be printed on the envelope by the coupon distribution system in accordance with the present invention.

Next, at 608, the data center 200 searches the third party advertiser database 206 for those advertiser that are interested in advertising on the envelope 20 associated with the hygiene recipient address 50. For the reasons discussed above, not every third party advertiser may want to advertise on every envelope 20. Generally, this step involves establishing an ad data profile for each advertisement and comparing the hygiened recipient address 50 to the ad data profile. Referring to FIG. 5, a schematic representation of an ad data profile file, generally designated 207, associated with a third party coupon to be printed on the envelope 20 by the postage printing system 10 is shown. The ad data includes: graphic image data 207*a;* a subsidy rate data 207*b;* a billing rate 207*c* and restriction data. The restriction data may include sender restriction data, addressee restriction data and non-addressee (quantitative) restriction data, or any combination of types of restriction data. Preferably, the addressee restriction data includes: geographic restriction data 207*d* and recipient restriction data 207*e*. Preferably, the non-addressee restriction data includes: date restriction data 207*f;* multi-ad restriction data 207*g;* and ad space restriction data 207*h*. Piece count restriction data and budget limit data defining a maximum amount of advertising charges for a given time period may also be included in the non-addressee restriction data. The graphic image data 207*a* is representative of the desired coupon and may be stored in any manner of well known formats, such as: PDF, JPEG, GIF and the like. The subsidy rate data 207*b* includes information corresponding to the credit value that will be applied to the user's account for authorizing printing of the third party coupon on the envelope 20. The billing rate data 207*c* includes information corresponding to the debit value that will be applied to the third party advertiser's account in conjunction with printing of the third party coupon on the envelope 20. The geographic restriction data 207*d* provides an indication of what geographic areas the third party advertiser wants to target. This may be manifested by a restriction on the originating location or the destination location or preferably both. The recipient restriction data 207*e* provides an indication of the target audience. For example, distinctions may be made between a commercial and a residential address. In the preferred embodiment, the commercial versus residential distinction may be obtained directly from the user or from the previously noted Address Matching System. Alternatively, this may also be accomplished by interrogating the hygiened recipient address 50 for certain "key words" indicative of company, such as: inc., incorporated, co., company and the like. As another example that may be used independent from or in combination with the example previously discuss, the address demographics database 212 allows further targeting of coupons. Generally, income, age and other demographic statistics are available for different regions of the country. Thus, the delivery point zip code in the hygiened recipient address 50 may be cross-referenced to the address demographics database 212 and the resulting demographic statistics compared with the third party advertiser's requirements. For example, a luxury car manufacturer may only want its ads going to private residences from regions where the average income is above a predetermined threshold. The date restriction data 207*f* provides an indication of what dates the third party advertiser wants to advertiser on. For example, expiration dates could be established beyond which the coupon would not be dispensed. As another example, periodic cycles ($1^{st}$ week of month, last week of month, on Mondays, 2 weeks before a holiday, etc.) could be established during which the coupon is available for printing. The multi-ad restriction data 207*g* provides an indication of whether or not the third party advertiser would allow another third party advertiser to advertiser on the envelope 20. The sentiment being that a multiplicity of coupons may dilute the effectiveness of the individual coupons versus if the individual coupons were used singularly. If the third party advertiser allows other advertisers, then a reduced credit indicated in the subsidy rate data 207*b* and a reduced debit that is indicated in the billing rate data 207*c* might be applied when multiple coupons are employed. The ad space restriction data 207*h* provides an indication of which ad zones 60*a,* 60*b,* 60*c* and 60*d* the third party advertiser authorizer for use with the coupon. Thus, the third party advertiser may exercise some control over where on the envelope 20 the coupon is printed. Similarly, as an option, the user may also provide an indication of which ad zones 60*a,* 60*b,* 60*c* and 60*d* the user may be printed in. For example, the user may be using an envelope 20 with preprinted images already occupying a portion of one or more ad zones 60*a,* 60*b,* 60*c* and 60*d.* In this scenario, the ad restriction data 207*h* and the user's input must be reconciled. Those skilled in the art will recognize that above described restriction data 207*d,* 207*e,* 207*f,* 207*g* and 207*h* may be utilized independently from each other or in any desired combination. Still other restrictions may be utilized, such as piece count limits. It should now be apparent that the coupons that meet the restriction criteria and are available for printing represent a subset of the total number of coupons that are potentially available.

Again referring primarily to FIG. 4 while referencing the structure of FIGS. 1, 2, 3 and 5, once the available coupons are determined according to the restriction data described above, at 610, the relevant coupons and their corresponding subsidy rate 207*b* are presented to the user on the remote computer 150 via the user interface. This provides the user with the opportunity to view and analyze the available coupons along with their corresponding subsidy rate 207*b.* Next, at 612, the user selects a coupon for printing on the envelope 20 in conjunction with the postal indicium 30. For the sake of clarity and brevity, it will be assumed that only one (1) coupon 70 is selected for printing in ad space zone 60*a.* However, those skilled in the art will recognize that, as described above, multiple coupons may be printed. Next, at 614, the data center 200 generates a print data packet to be downloaded to the remote computer 150 for use in printing the postal indicium 30 and the selected coupon 70. Preferably, the print data packet contains only information corresponding to the variable data portion of the postal indicium 30. In this embodiment, the remote computer 150 assembles the variable data with the fixed data that has been previously stored on the remote computer 150 to create a complete postal indicium 30. The print data packet also contains graphic information necessary to print the selected coupon 70. Once the data packet has been received, the user can feed the envelope 20 through the printer 130 to effect printing. Next, at 616, the data center 200 updates the user account to reflect the transaction information, such as: the date, the postage amount dispensed, the hygiened address 50, the selected coupon 70, the corresponding subsidy, any fees associated with providing the above described services and any other relevant data. Similarly, the data center 200 updates the selected third party advertiser's account to reflect the transaction information, such as: the date, the selected coupon 70, the corresponding advertising fee, any additional fees associated with providing the above described services and any other relevant data. At a later time, the data center 200 exercises the preferred payment vehicle for the user and the selected third party advertiser, respectively. In an alternate embodiment, a single coupon is automatically selected for printing on the envelope and the only choice available to the user is whether the user accepts the coupon for printing.

Based on the above description and the associated drawings, it should now be apparent that the present invention improves the ability of third party advertisers more efficiently reach their target audience through advertising on envelopes.

In the preferred embodiment of the present invention, the third party advertising is in the form of digital, redeemable coupons that are printed on envelope 20. Such coupons are very similar to the "clip and save" coupons used by customers in traditional purchases, such as in supermarkets and department stores. Through the ad data profile 207, the third party advertiser may authorize the issuance of such coupons, or a user may authorize third party advertising in the form of such coupons. The present invention is superior to current coupon redemption methods in that the third party advertiser has control over the distribution of the coupons and the amount of coupons distributed. The coupons might be tailored to specific recipients as the ultimate in direct marketing. For example, if addressee information identifies a particular recipient, who purchased a car from an automobile manufacturer (nationally) and dealer (locally), the manufacturer or dealer might order a coupon for instant rebate for a new car on a mailpiece addresses to the particular recipient.

The digital, redeemable coupon includes conventional information, such as an identification of the third party advertiser and an amount or percentage of discount for a specific purchase. In accordance with the preferred embodiment of the present invention, the coupon also includes information that allows the redemption system to authenticate the coupon. Conventional methods of authenticating documents, such as verifying a unique number, digital signature, digital certificate or other encrypted information, may be used. The coupon may further include information identifying the mailpiece addressee and/or the user who generated the mailpiece. Such information may be encoded as secure information and may be printed as part of a bar code, such as a 2-D bar code. It will be understood that such information would be useful to the third party advertiser for various reasons including evaluation of the benefits of the third party advertising. The information preferably includes demographic information that can be collected by a retailer or a third party advertiser. Such information could be used to generate or enhance a mailing list for either the retailer or the third party advertiser.

Figure 6:
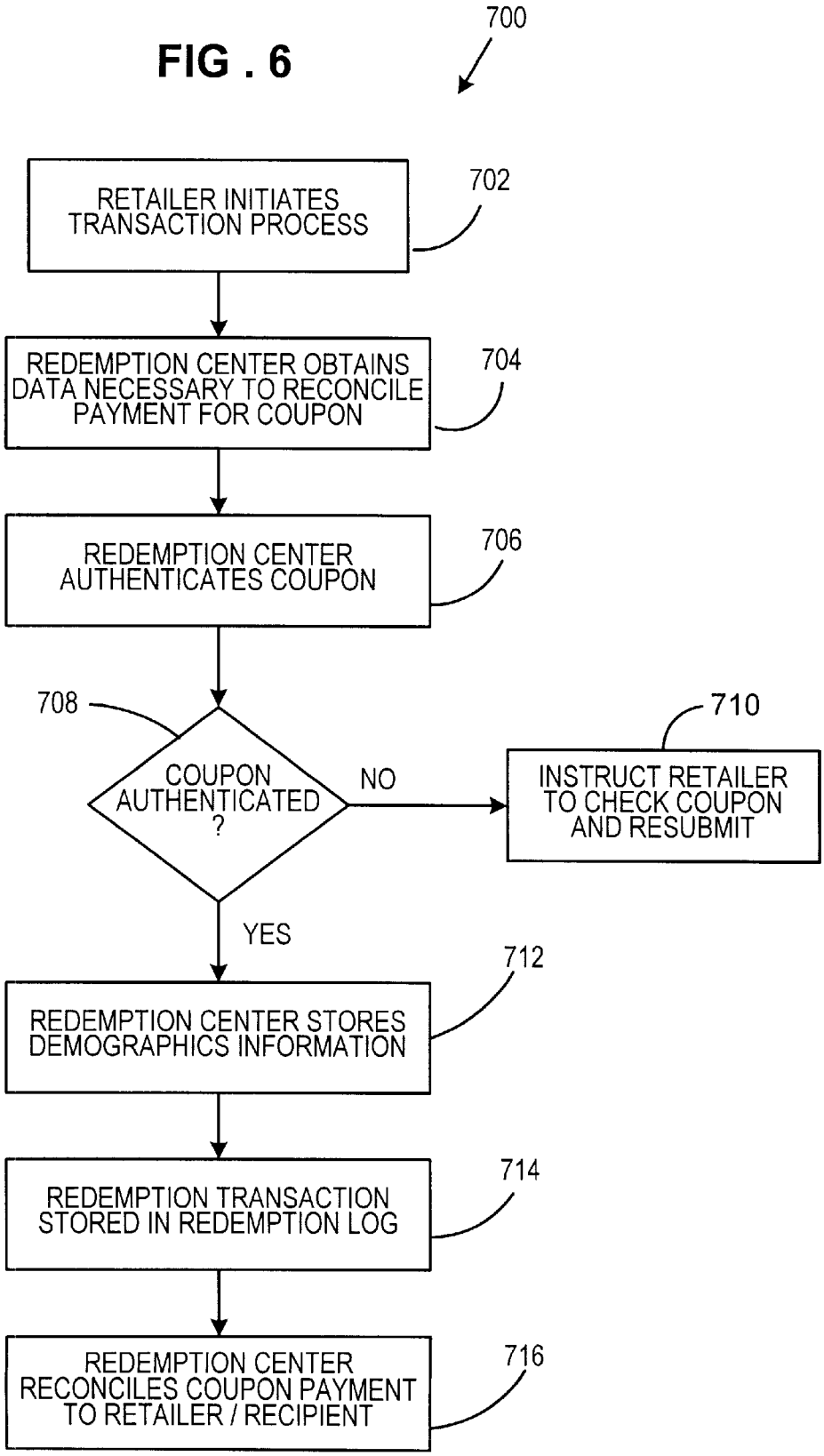
FIG. 6 is a flow chart showing a process of redeeming a coupon in accordance with the present invention.

Referring now primarily to FIG. 6 while referencing the structure of FIG. 3, a process of redeeming a coupon in accordance with the present invention is shown. The redemption routine 700 may be comprised of any suitable combination of software, firmware and hardware subsystems executed by the redemption control system 502 and the data center control system 202, and, if redemption is through retailer 400, a retailer computer 402. For on-line redemption transactions, the activities of the redemption center 500 are such that they may be fully automated. On the other hand, off-line transactions may require manual interactive coupon data entry. For the sake of clarity and brevity, the redemption process 700 assumes an on-line transaction.

At 702, the remote transaction routine 700 commences when the retailer computer 402 contacts redemption center 500 to establish a session to initiate the transaction process. In this manner, the retailer computer 402 and redemption center 500 recognize each other as authentic using any conventional mutual authentication technique. This generally involves the retailer computer 402 transmitting a valid account number or other identifying information and a corresponding password. In this manner, coupon payment is not inadvertently reconciled to one party while a second party is redeeming the coupon. Once the session has been established, at 704, the redemption center 500 obtains from retailer 400 relevant data necessary to reconcile payment for the coupon. This typically involves the retailer computer 402 transmitting the coupon information scanned by the retailer. Alternatively, the coupon information may be manually entered by the retailer 400. Next, at 706, the redemption center 500 authenticates the coupon by comparing coupon information, such as a unique coupon number, received from retailer 400 against information stored in the coupon database 504. Next, at 708, if the redemption center 500 cannot verify the authenticity of the coupon being redeemed, then, at 710, the retailer 400 may be instructed to check the coupon and resubmit it. On the other hand, if at 708 the coupon is authenticated, then at 712, redemption center 500 stores the demographics information scanned from the coupon into demographic database 512. At 714, the redemption transaction is stored in redemption log 510. At some predetermined interval, redemption center 500, at 716, reconciles coupon payment to retailer 400 based on the transaction records retrieved from redemption log 510.

The coupon will include conventional coupon information such as the amount, expiration date and manufacturer's name. In accordance with the present invention, additional information, such as a unique coupon identification number, recipient information and demographic information may be printed on the coupon. Furthermore, a conventional cryptographic process similar to that used in evidencing postage payment could be used to provide a reliable authentication process during redemption of the coupon.

The manufacturer, the redeeming retailer or the vendor administering the third party advertising process, could accumulate such additional information in the redemption process for their own use. For example, the manufacturer could use such information to determine the effectiveness of the coupon marketing strategy and to fine-tune such strategy. The redeeming retailer could use such information to determine its customers for its own direct marketing coupon advertising campaign. Finally, the vendor administering the third party advertising process could use such information to collect data for use in selling its third party advertising process to other manufacturers and retailers.

Manufacturers may want to police the redemption of their coupons to prevent fraudulent use of the digital coupons. For example, by monitoring the unique coupon identification numbers, the vendor can prevent duplicate use of the coupons. If the redemption is being done on line, the system would detect the fraudulent use and prevent the coupon transaction from being completed.

Although the present invention is suitable for both on-line and off-line redemption, the on-line redemption process is preferred. In the on-line redemption the information, which is scanned from the coupon, is immediately transmitted to the vendor data center, verified and accumulated before the transaction is completed. At the end of the day, or at some prearranged interval, the vendor transmits the information to the manufacturer or a representative of the manufacturer responsible for the coupon advertising. When the cryptographic process is part of the on-line redemption, the vendor data center operates as a trusted third party in performing the authentication. Once the coupon is authenticated, the coupon can be discarded. Thus, the on-line redemption eliminates the manual processing of the coupon because all the information from the transaction has been accumulated and distributed. The retailer will be reimbursed for the discount automatically from the transaction record.

Preferably, the off-line redemption is done as follows. The retailer receives the coupon locally, optionally authenticates the coupon, provides the instant discount or rebate, and later transmits the information scanned from the coupon to the vendor administering the third party advertising process or directly to the manufacturer or a representative of the manufacturer responsible for the coupon advertising. The authentication process may include a public key cryptographic process whereby the scanned information includes all or part of a certificate or digital signature of the information printed on the coupon. Alternatively, the retailer may send the physical coupon to the manufacturer or manufacturer representative instead of or in addition to transmitting the scanned information.

Alternatively, the off-line redemption may be done as described above except that the rebate is mailed to the customer by the manufacturer or a representative of the manufacturer responsible for the coupon advertising.

Many features of the preferred embodiment represent design choices selected to best exploit the inventive concept as implemented in a particular virtual postage meter environment. However, those skilled in the art will recognize that various modifications can be made without departing from the spirit of the present invention. For example, the address hygiene database 210 and the third party advertiser database 206 may be resident at the remote computer 150. Thus, a portion of the functionality of the data center 200 described above would be off loaded to the remote computer 150. The remote computers 150 could then periodically receive updated information concerning the address hygiene database 210 and the third party advertiser database 206 by any conventional means. Thus, those skilled in the art will recognize that there are many ways to distribute the functionality described above between the data center 200 and the remote computer 150. As yet another example, different billing rates may be applied for multi-color versus monocolor printing capability. Thus, users with multi-color printers may be offered higher subsidies.

Therefore, the inventive concept in its broader aspects is not limited to the specific details of the preferred embodiments described above, but is defined by the appended claims and their equivalents.

What is claimed is:

1. A coupon distribution system for distributing coupons, the system comprising:

a postage printing system including a computer in operative communication with a printer for printing a postal indicium on an envelope;

a data center in operative communication with the computer, the computer being located remotely from the data center, the data center including a plurality of third party advertiser accounts, each of the third party advertiser accounts including respective ad data having coupon data and restriction data, each of the coupon data representative of a coupon to be printed;

a control system in operative communication with the data center and the computer for:

establishing a transaction session between the computer and the data center to generate the postal indicium;

obtaining recipient address information from the user; and using the recipient address information and the restriction data from the plurality of advertiser accounts to identify a subset of coupons available for printing on an envelope in conjunction with the postal indicium; and a redemption center in operative communication with the data center and coupon redeemers for reconciling payments corresponding to redeemed coupons.

2. The coupon distribution system of claim 1, wherein the computer is a personal computer, the postage printing system further includes a postage security device (PSD) in operative communication with the computer for providing account processing relating to the postal indicium, the PSD is directly coupled to the personal computer and the subset of coupons is transmitted to the computer by the data center and is stored on a hard drive of the personal computer, whereby the subset of coupons is available for selection through the personal computer by the user each time postage evidencing is requested for the envelope.

3. The coupon distribution system of claim 1, wherein the computer is a personal computer that is part of a local area network, a PSD for providing account processing relating to the postal indicium is in operative communication with the personal computer through the local area network and the subset of coupons is stored on storage means within the local area network whereby the subset of coupons is available for selection through the personal computer by the user each time postage evidencing is requested for the envelope.

4. The coupon distribution system of claim 1, wherein the computer is a personal computer, a PSD for providing account processing relating to the postal indicium is located at the data center, the data center including a plurality of postage accounts corresponding respectively to a plurality of users, and respective subsets of coupons corresponding to respective ones of the plurality of user postage accounts are stored on storage means at the data center, whereby the subset of coupons corresponding to the user is available for selection through the personal computer by the user each time postage evidencing is requested by the user for an envelope.

5. The coupon distribution system of claim 1, wherein:

the control system is further for receiving from the user an indication of a selected coupon from the subset of coupons that the user authorizes for printing on the envelope.

6. The coupon distribution system of claim 5, wherein:

the control system is further for applying a credit to the user postage account corresponding to the user; and for applying a debit to the third party advertiser account corresponding to the selected coupon.

7. The coupon distribution system of claim 6, wherein:

each of the restriction data, respectively, includes addressee restriction data and non-addressee restriction data.

8. The coupon distribution system of claim 7, wherein:

the addressee restriction data, respectively, includes at least information relating to one of the following: commercial/residential restrictions; demographic restrictions and geographic restrictions.

9. The coupon distribution system of claim 8, wherein:

the envelope includes a plurality of coupon space zones; and the non-addressee restriction data, respectively, includes at least information relating to one of the following: piece count restrictions; multi-ad restrictions; date restrictions; ad space zone restrictions and budget restrictions.

10. A method of operating a coupon distribution system within a postage printing system, the coupon distribution system including a computer in operative communication with a printer for printing a postal indicium on an envelope and a data center in operative communication with the computer, the computer being located remotely from the data center, the data center including a plurality of postage accounts and a plurality of advertiser accounts, each of the plurality of advertiser accounts including respective ad data having coupon data and restriction data, each of the coupon data representative of a coupon, for printing on the envelope, the method comprising the step(s) of:

establishing a transaction session between the computer and the data center, the user corresponding to one of the plurality of postage accounts;

obtaining recipient address information from the user; and using the recipient address information and the restriction data from the plurality of advertiser accounts to identify a subset of coupons available for printing on the envelope in conjunction with the postal indicium.

11. The method of claim 10, further comprising the step of:

reconciling payments corresponding to a redeemed coupon of the subset of coupons.

12. The method of claim 10, further comprising the step of:

receiving from the user an indication of a selected coupon from the subset of coupons that the user authorizes for printing on the envelope.

13. The method of claim 12, further comprising the step(s) of:

applying a credit to the postage account corresponding to the user; and applying a debit to the advertiser account corresponding to the selected coupon.

14. The method of claim 13, wherein:

each of the restriction data, respectively, includes addressee restriction data and non-addressee restriction data.

15. The method of claim 14, wherein:

the envelope includes a plurality of ad space zones; and the non-addressee restriction data, respectively, includes at least information relating to one of the following: piece count restrictions; multi-ad restrictions; date restrictions; ad space zone restrictions and budget restrictions.

16. The method of claim 14, wherein:

the addressee restriction data, respectively, includes at least information relating to one of the following: commercial/residential restrictions; demographic restrictions and geographic restrictions.

17. The method of claim 16, wherein:

the envelope includes a plurality of ad space zones; and the non-addressee restriction data, respectively, includes at least information relating to one of the following: piece count restrictions; multi-ad restrictions; date restrictions; ad space zone restrictions and budget restrictions.

18. A method of operating a data center, the data center in operative communication with a computer system including a printer for printing a postal indicium on an envelope, the method comprising the step(s) of:

maintaining a plurality of postage accounts;

maintaining a plurality of advertiser accounts, each of the plurality of advertiser accounts including respective ad data having coupon data and restriction data, each of the coupon data representative of a coupon, respectively, for printing on the envelope;

establishing a transaction session with a user of the computer system, the user corresponding to one of the plurality of postage accounts;

receiving recipient address information from the user; and using the recipient address information and the restriction data from the plurality of advertiser accounts to identify a subset of coupons available for printing on the envelope in conjunction with the postal indicium.

19. The method of claim 18, further comprising the step of:

receiving from the user an indication of a selected coupon from the subset of coupons that the user authorizes for printing on the envelope.

20. The method of claim 19, further comprising the step(s) of:

applying a credit to the postage account corresponding to the user; and applying a debit to the advertiser account corresponding to the selected coupon.

21. The method of claim 20, further comprising the step of:

reconciling payments corresponding to a redeemed coupon of the subset of coupons.

22. The method of claim 21, wherein the step of reconciling comprises the steps of:

authenticating the redeemed coupon;

paying an amount corresponding to a value indicated on the redeemed coupon;

accumulating demographic information retrieved from the redeemed coupon.

23. The method of claim 22, wherein the step of reconciling is initiated by an on-line transaction between a retailer receiving the redeemed coupon and a redemption center responsible for reconciling payments from an advertiser corresponding to the redeemed coupon and the retailer.

24. The method of claim 20, wherein:

each of the restriction data, respectively, includes addressee restriction data and non-addressee restriction data.

25. The method of claim 24, wherein:

the addressee restriction data, respectively, includes at least information relating to one of the following: commercial/residential restrictions; demographic restrictions and geographic restrictions.

26. The method of claim 25, wherein:

the envelope includes a plurality of ad space zones; and the non-addressee restriction data, respectively, includes at least information relating to one of the following: piece count restrictions; multi-ad restrictions; date restrictions; ad space zone restrictions and budget restrictions.

27. The method of claim 26, wherein:

the envelope includes a plurality of ad space zones; and the non-addressee restriction data, respectively, includes at least information relating to one of the following: piece count restrictions; multi-ad restrictions; date restrictions; ad space zone restrictions and budget restrictions.

28. A product, comprising:

a computer readable medium; and executable code for a postage application on the computer readable medium, wherein when read and executed the code for the postage application causes a programmable processor to perform the following steps:

receiving a request for an indicia from a non-postage application via an application program interface;

in response to the request, establishing a transaction session between the computer and a data center;

sending to the data center recipient address information corresponding to a mailpiece; and receiving from the data center a subset of coupons available for printing on the mailpiece; and printing a postage indicia and at least one coupon of the subset of coupons on the mailpiece.

29. A product as in claim 28, wherein the computer readable medium comprises a memory device of the programmable processor.

* * * * *